US008608007B2

(12) United States Patent
Seo

(10) Patent No.: US 8,608,007 B2
(45) Date of Patent: Dec. 17, 2013

(54) RESEALABLE EASY-OPEN END

(76) Inventor: Jin Hyok Seo, Seoul (KR)

( * ) Notice: Subject to any disclaimer, the term of this patent is extended or adjusted under 35 U.S.C. 154(b) by 0 days.

(21) Appl. No.: 13/519,135

(22) PCT Filed: May 13, 2011

(86) PCT No.: PCT/KR2011/003537

§ 371 (c)(1),
(2), (4) Date: Jun. 26, 2012

(87) PCT Pub. No.: WO2011/149207

PCT Pub. Date: Dec. 1, 2011

(65) Prior Publication Data

US 2012/0285962 A1 Nov. 15, 2012

(30) Foreign Application Priority Data

May 25, 2010 (KR) ..... 10-2010-0048475

(51) Int. Cl.
*B65D 17/34* (2006.01)

(52) U.S. Cl.
USPC ..... 220/258.2; 220/269; 220/270; 220/820; 220/821; 220/906

(58) Field of Classification Search
USPC ..... 220/258, 258.2, 257.2, 259.3, 262, 265, 220/266, 278, 293, 269, 270, 906, 730, 220/254.4, 258.5
See application file for complete search history.

(56) References Cited

U.S. PATENT DOCUMENTS

2007/0138178 A1* 6/2007 Erickson ..... 220/254.4

FOREIGN PATENT DOCUMENTS

| | | | |
|---|---|---|---|
| JP | 9156637 | A | 6/1997 |
| KR | 20000036222 | A | 6/2000 |
| KR | 200341592 | Y1 | 2/2004 |
| KR | 100908477 | B1 | 7/2009 |

* cited by examiner

*Primary Examiner* — Mickey Yu
*Assistant Examiner* — Allan Stevens
(74) *Attorney, Agent, or Firm* — The Webb Law Firm

(57) ABSTRACT

Provided is a resealable easy-open end including a panel functioning as an end for hermetically sealing a can and having an opening formed at one side thereof and on which a score (S) is engraved; a tab having a first button hole formed in a button coupling part formed at a center thereof, rotatably coupled to a first button protruding from the panel through the first button hole, and rotatably installed between a first position at which a front end pressing part is disposed on the opening and a second position at which a rear end finger portion is disposed on the opening; and a closing plate rotatably installed between the first position and the second position, and to configured to be supported by the tab at the second position to close the opening when the tab breaks the score to open the opening.

7 Claims, 7 Drawing Sheets

RESEALABLE EASY-OPEN END

TECHNICAL FIELD

The present invention relates to an end of a can, particularly, to an easy-open end of a can having a score formed on a panel forming an upper end of the can such that the score can be easily broken by a tab to easily open the can, and more particularly, to a resealable easy-open end of a can having an opening that can be closed to prevent leakage of a beverage and/or carbonic acid gas therein, when a user carries the can and moves therewith, after the score of the end is broken by the tab to open the can.

BACKGROUND ART

In general, a can includes a cylindrical can body, and an end hermetically coupled to an upper end portion of the can body. The end is a term used to designate an entire portion forming an upper end of the can.

The end is manufactured of aluminum or aluminum alloy and coupled to the upper end of a can body formed of a metal material. The upper end portion of the can body and the edge portion of the end are seamed by a seaming chuck and a seaming roll in a beverage bottling plant to hermetically seal a beverage therein.

A tab having an opening, in which a score S having a broken line shape is formed, is installed at one side of a surface of the panel forming the end, and the score is pressed and broken using leverage to open the opening. The tab is fixed to the panel by a rivet.

Accordingly, when a user pulls up an end of the tab, the other end of the tab disposed on the score is leveraged and presses the score to break the score along the broken line, opening the opening.

However, the conventional can has no structure capable of re-closing the opening of the can, which is opened by breaking the score. Accordingly, there is inconvenience in carrying and transporting the can in which contents remain to be drunk at a later time, or in storing the contents after the can is opened.

In order to solve these problems, a technique of providing a plastic cover on the end has been proposed. However, as the beverage moves over the end panel, foreign substances on the panel may mix with the beverage.

In addition, while various ideas about the structure of re-closing the opening have been proposed, these ideas require new can manufacturing processes, and due to problems of changing equipment, can manufacturing companies and beverage companies cannot employ the various ideas. That is, the can manufacturing companies and the beverage companies require a resealable can end structure that can be implemented using the conventional beverage plant filling equipment and process, and while maintaining a conventional production speed.

Meanwhile, in recent times, various events, promotions, advertisements, and so on, are being distributed through beverage cans. For example, a promotion method is used in which a serial number is printed on a rear surface, which is pulled up when the score is broken, with the tab structure with no hole, and a consumer inputs the serial number on a computer web to confirm whether the consumer wins a giveaway. It has been confirmed that the method of printing the serial number on the rear surface of the tab raises customer interest and attention.

However, in order to print the serial number on the rear surface of the tab, since the serial number must be previously printed on the panel and the tab should be machined to correspond to the printed portion, manufacture of the tab is difficult. In addition, the rear surface of the tab has a small printing area. Consequently, even when the company wants to write various advertisement phrases, and so on, to improve advertisement effects, it is unable to.

Meanwhile, due to disadvantages such as an increase in manufacturing cost and limitation of advertisement effects, some beverage companies use a method in which the serial number and the advertisement phrase are written together on a side surface or a bottom surface of the can body of the can, not the tab. However, this method is not as effective at attracting the attention of users. That is, in order to maximize the to effects of events, promotions, and so on, a process that arouses a consumer's interest and attention by exposure of the advertisement phrase and serial number through a series of operations related to the opening of the can is needed, because the method of complete exposure before opening reduces consumer interest.

Accordingly, in the beverage industry, there is increasing demand for a can having a hidden printing space for events, promotions, and so on, that is sufficient for advertisement phrases, etc., and arouses the interest and attention of consumers.

DISCLOSURE

Technical Problem

In order to solve the foregoing and/or other problems, it is an aspect of the present invention to provide a resealable easy-open end than can prevent leakage of contents and enable carrying and storing of a can by re-closing an opening after the can is opened.

In addition, it is another aspect of the present invention to provide a resealable easy-open end that can be manufactured using conventional can manufacturing equipment with only a simple modification, without exchanging the equipment.

Further, it is another aspect of the present invention to provide a resealable easy-open end capable of providing a hidden printing space for events, promotions, and so on.

Technical Solution

The foregoing and/or other aspects of the present invention may be achieved by providing a resealable easy-open end including a panel functioning as an end for hermetically sealing a can and having an opening formed at one side thereof and on which a score S is engraved; a tab having a first button hole formed in a button coupling part formed at a center thereof, rotatably coupled to a first button protruding from the panel through the first button hole, and rotatably installed between a first position at which a front end pressing part is disposed on the opening and a second position at which a rear end finger portion is disposed on the opening; and a closing plate rotatably installed between the first position and the second position, and configured to be supported by the tab at the second position to close the opening when the tab breaks the score to open the opening.

According to the present invention, the closing plate may be disposed between the panel and the tab, a second button hole may be formed in the button coupling part of the tab, a button through-hole through which the first button passes and a protruding second button may be formed at the closing plate, the first button may pass through the button through-hole to be rotatably riveted to the tab, and the second button may pass through the second button hole to be riveted thereto, so that the closing plate is integrally rotated with the tab.

According to the present invention, a leverage bubble may be formed at a surface of the panel to raise the pressing part of the tab in a state in which the tab is disposed at the second position so that the finger portion presses the closing plate according to the lever principle, and the closing plate may have a bubble receiving groove to receive the leverage bubble to prevent interference of the leverage bubble with the closing plate when the closing plate is disposed at the first position.

According to the present invention, the closing plate may have a finger portion support protrusion protruding downward from the finger portion.

According to the present invention, the tab may be bent in a triangular shape by raising a center portion thereof.

According to the present invention, a first concave surface having a recessed to surface shape and receiving the closing plate at a region corresponding to the first position and the second position of the closing plate may be formed on the surface of the panel, a second concave surface having a region of the first concave surface and a region corresponding to a path through which the closing plate moves between the first position and the second position may be provided on the surface of the panel, and thus, a step may be formed at a boundary between the surface of the panel, the first concave surface and the second concave surface, and a boundary between the first concave surface and the second concave surface.

According to the present invention, a printing space on which a phrase for an event or promotion is printed may be provided at the surface of the panel under the second position of the closing plate, and the printing space may be exposed when the closing plate is moved with the tab to the second position.

Advantageous Effects

According to the resealable easy-open end of the present invention, the consumer can carry the can while preventing leakage of a beverage and a carbonic acid gas by re-closing the opening after the can is opened.

According to the present invention, the beverage contained in the can can be maintained fresh and tasty even after the can is opened, and introduction of foreign substances such as dust, insects, etc. into the can can be prevented. Accordingly, since the beverage in the can can be stored even after the can is opened, even beverage products of 500 ml or more, which are currently distributed in PET and glass bottles, can be distributed in cans.

In addition, the resealable easy-open end of the present invention has the advantage of being producible using a conventional can manufacturing process and equipment with only a simple modification. The conventional can manufacturing process is used to manufacture the end through processes of cutting an original plate into circular plates, a press process, and a tab forming process. However, in the resealable easy-open end according to the present invention, processes of the conventional end process are performed without modification, and the closing plate can be manufactured using the conventional end processing equipment.

Further, the resealable easy-open end of the present invention provides the hidden printing space for events, promotions, and so on. Here, since the printing space can have a relatively large area, events and promotions can be carried out utilizing various advertisement phrases, and consumer interest and attention can be aroused.

DESCRIPTION OF DRAWINGS

The above and other aspects and advantages of the present invention will become apparent and more readily appreciated from the following description of exemplary embodiments, taken in conjunction with the accompanying drawings of which.

MODE FOR INVENTION

Hereinafter, an embodiment of the present invention will be described in detail with reference to the accompanying drawings.

Figure 1:
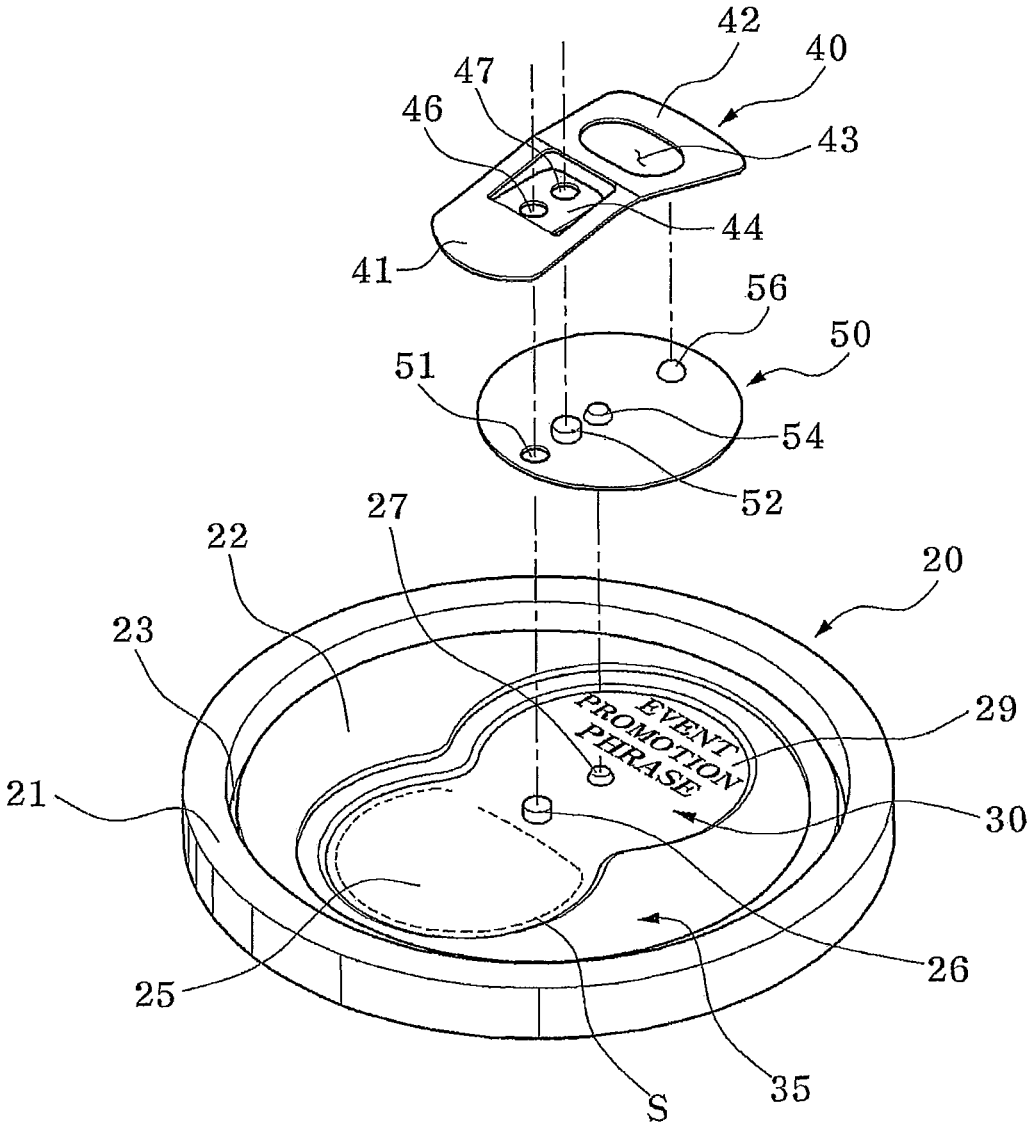
FIG. 1 is a perspective view of a resealable easy-open end according to the present invention.
Figure 2:
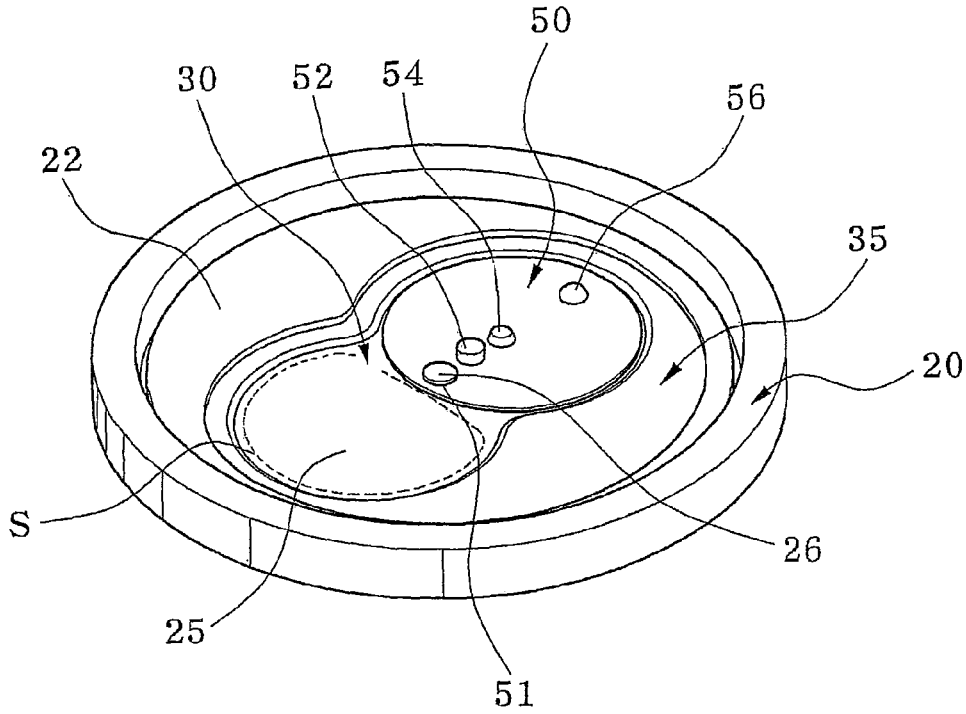
FIG. 2 is a view of part of the resealable easy-open end according to the present invention.
Figure 3:
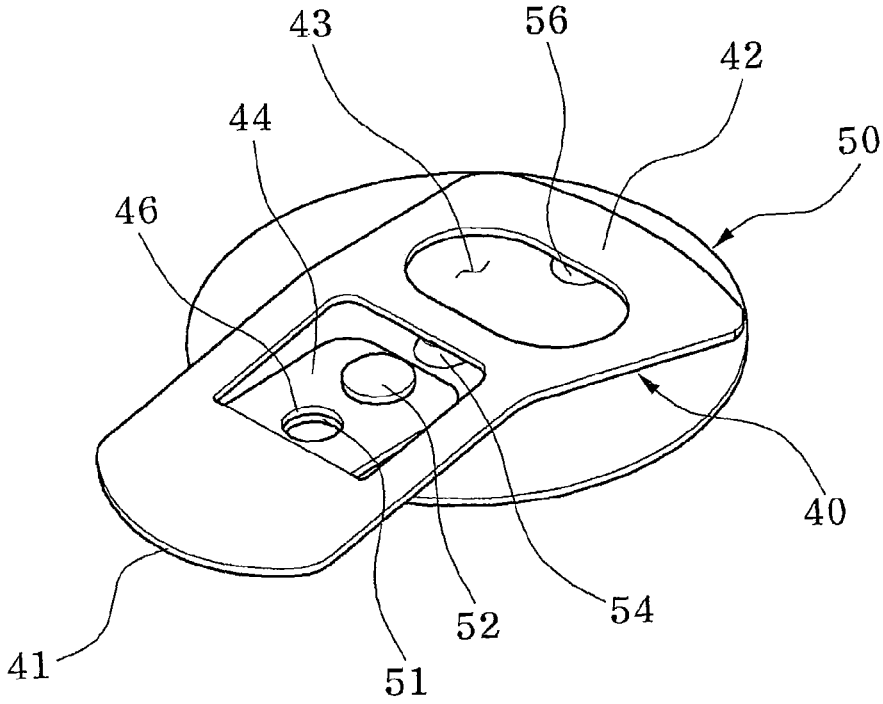
FIG. 3 is a view of a panel coupled with a closing plate of the resealable easy-open end according to the present invention.
Figure 4:
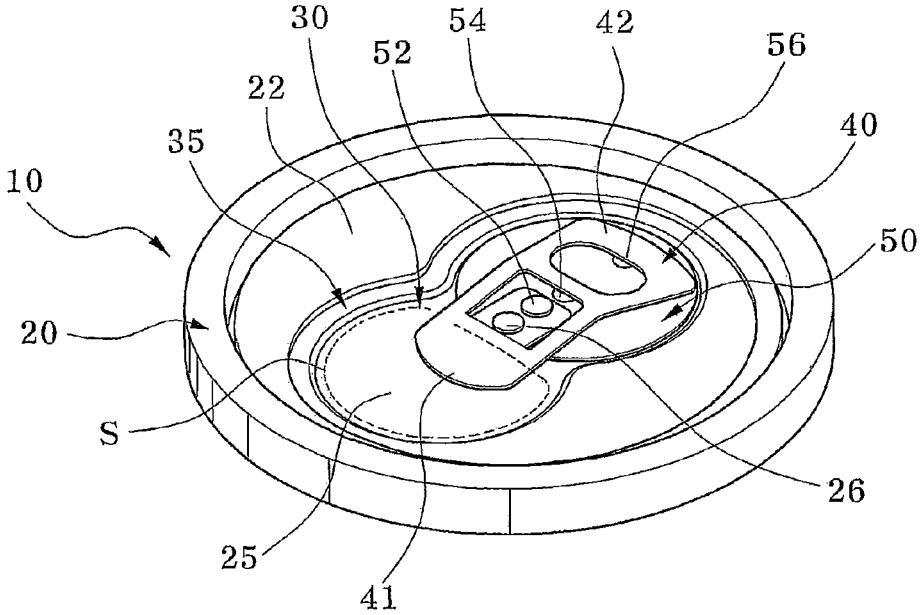
FIG. 4 is a view of a closing plate coupled with a panel of the resealable easy-open end according to the present invention.
Figure 5:
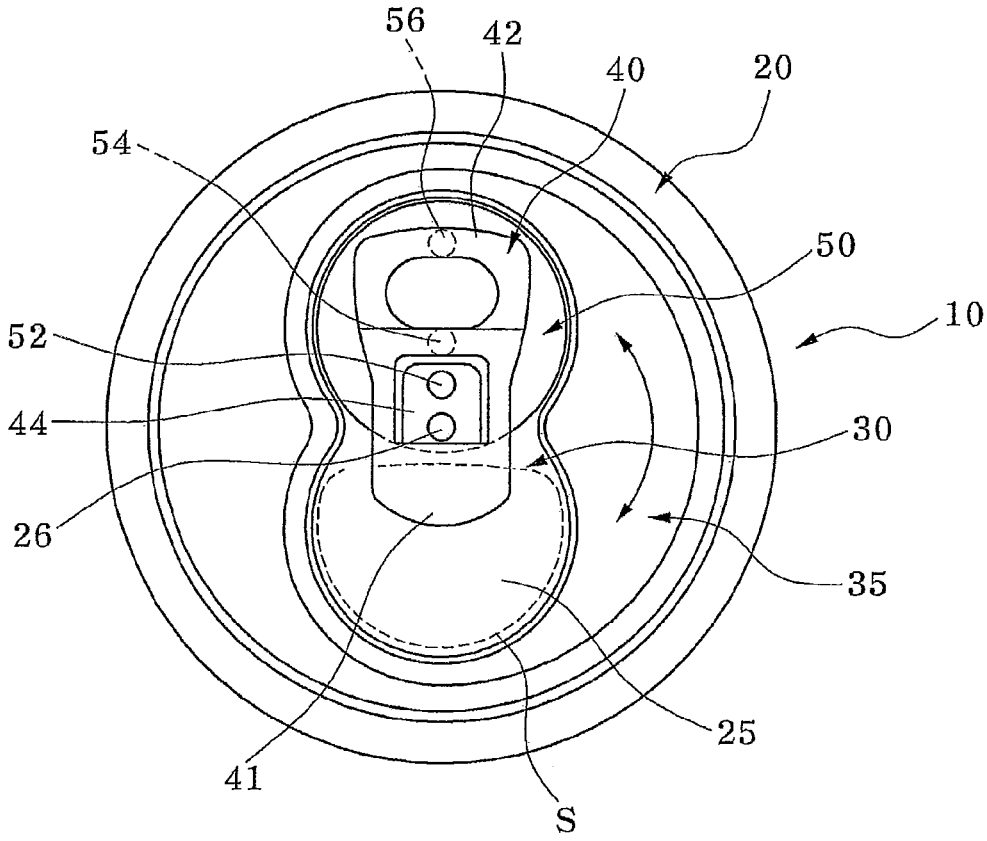
FIG. 5 is a plan view of the resealable easy-open end according to the present invention when a tab is at a first position.
Figure 6:
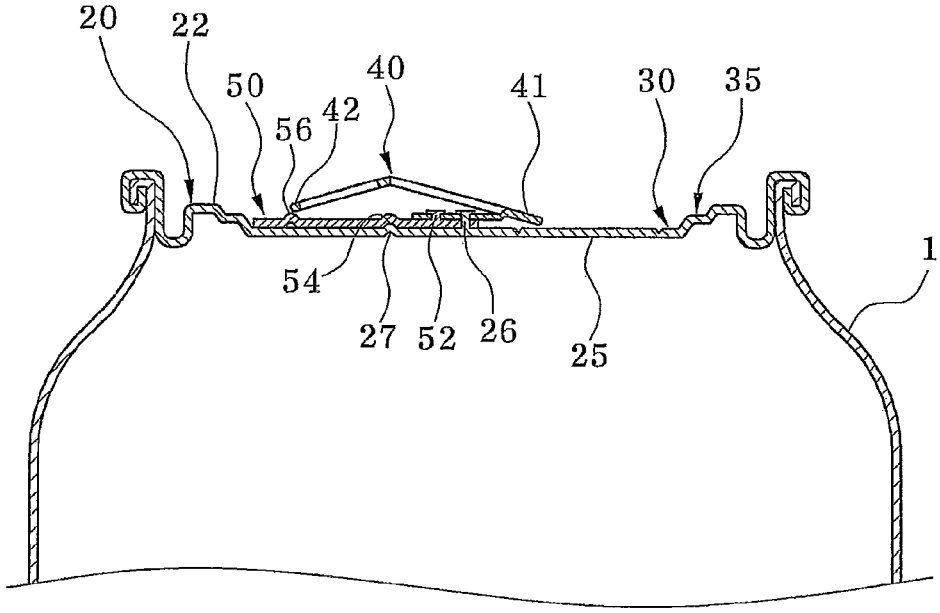
FIG. 6 is a cross-sectional view of the resealable easy-open end shown in FIG. 5.
Figure 7:
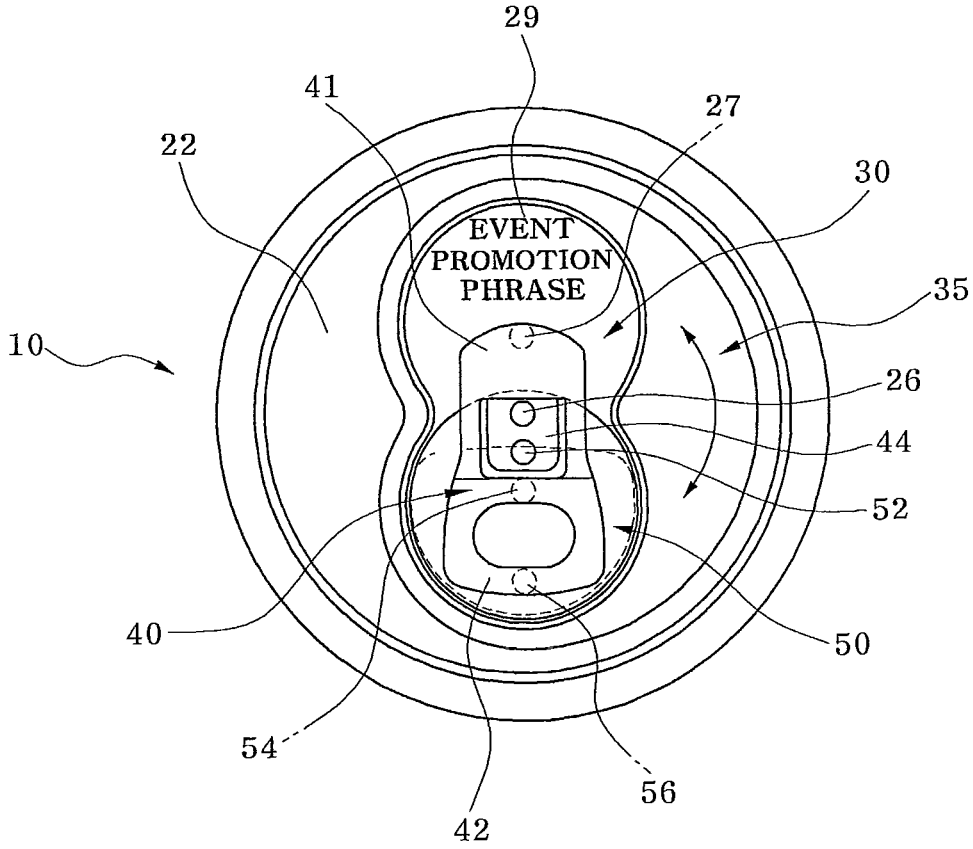
FIG. 7 is a view showing the resealable easy-open end according to the present invention in a state in which the tab is rotated to a second position.
Figure 8:
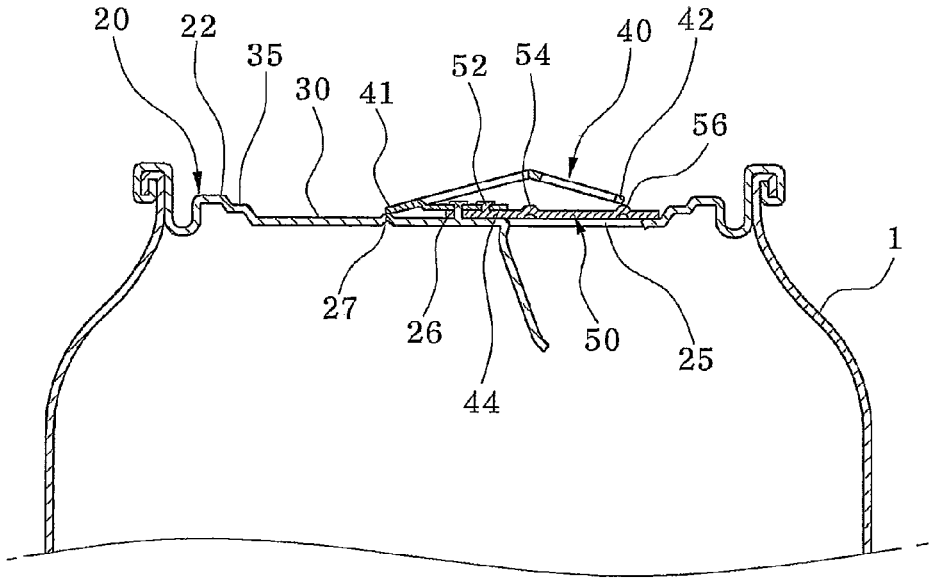
FIG. 8 is a cross-sectional view of the resealable easy-open end shown in FIG. 7.

FIG. 1 is a perspective view of a resealable easy-open end according to the present invention, FIG. 2 is a view of part of the resealable easy-open end according to the present invention, FIG. 3 is a view of a panel coupled with a closing plate of the resealable easy-open end according to the present invention, FIG. 4 is a view of a closing plate coupled with a panel of the resealable easy-open end according to the present invention, FIG. 5 is a plan view of the resealable easy-open end according to the present invention when a tab is at a first position, FIG. 6 is a cross-sectional view of the resealable easy-open end shown in FIG. 5, FIG. 7 is a view showing the resealable easy-open end according to the present invention in a state in which the tab is rotated to a second position, and FIG. 8 is a cross-sectional view of the resealable easy-open end shown in FIG. 7.

A resealable easy-open end 10 according to the present invention includes a panel 20 coupled to an upper end of a can. An edge portion 21 disposed at a side end of the panel 20 is bent to be seaming-coupled to an upper end portion of a can body 1 (see FIGS. 6 and 8) to seal a beverage therein.

A counter sink 23 having an annular groove is formed at an edge of an inner panel surface 22 of the edge portion 21 of the panel 20. The counter sink 23 functions to endure an inner pressure of the can, and allows an end 10 to be fixed to a seaming chuck to seam the can body 1 and the end 10. In addition, the seaming chuck is mounted on a portion of the counter sink 23 at a beverage bottling plant so that the body 1 and the end 10 of the can can be sealed by a seaming roll. Further, the counter sink 23 becomes a portion on which a bottom of the can, among stacked complete products, is seated.

The resealable easy-open end 10 according to the present invention includes a closing plate 50 and a tab 40 disposed on a surface 22 of the panel 20 forming the end 10.

Referring to the drawings, the surface 22 of the panel 20 of the resealable easy-open end 10 according to the present invention includes an opening 25 having a score S with a broken line at one side of the panel surface 22, like the well-known end.

A center portion of the surface 22 of the panel 20 includes a first button 26 protruding upward from the surface 22 through pressing. The closing plate 50 and the tab 40 are riveted to the first button 26.

According to the present invention, a leverage bubble 27 protruding from the panel surface 22 is formed at a rear side of the first button 26. The leverage bubble 27 raises a front end pressing part 41 of the tab 40 so that a rear end finger portion 42 can press the closing plate 50 when the closing plate 50 is rotated with the tab 40 to a second position to close the opening 25.

According to the present invention, a first concave surface 30 is formed at the surface 22 of the panel 20. The first concave surface 30 is a receiving groove including a first position and second position region of the closing plate 50 and configured to receive the closing plate 50 at the first position and the second position. The first concave surface 30 includes the opening 25 in which the score S is engraved, i.e., the opening 25 is formed at the first concave surface 30 and includes a region about the first button 26 and opposite to the opening 25. The region opposite to the opening 25 is a region hidden when the closing plate 50 is disposed at the first position, and forms a printing space 29 (described later).

The first concave surface 30 is formed by pressing the surface 22 of the panel 20. The first concave surface 30 is a recessed region in comparison with the other portion of the surface 22 of the panel 20, which is not pressed.

According to the present invention, the surface 22 of the panel 20 includes a region having the first concave surface 30, and a second concave surface 35 having a heart shape formed by pressing the surface 22 of the panel 20.

The second concave surface 35 surrounds a region of the first concave surface 30 and a moving path of the closing plate 50. Since the second concave surface 35 surrounds the region of the first concave surface 30, comparing the region of the first concave surface 30 with the other region of the second concave surface 35 not corresponding to the region of the first concave surface 30, the region of the first concave surface 30 is lower than the region of the second concave surface 35. The region of the second concave surface 35 is formed by pressing the surface 22 of the panel 20, and has a step formed at a boundary with the surface 22 of the panel 20, which is not pressed. The step increases a pressure-resistance of the surface 22 of the panel and prevents deformation of the surface 22 of the panel during an operation in which the tab 40 is operated according to the lever principle to break the score S. The first concave surface 30 also increases the pressure-resistance and the anti-deformation effect of the surface 22 of the panel. According to the present invention, the first concave surface 30 and the second concave surface 35 stepped and recessed from the surface 22 of the panel also form the first concave surface 30 stepped and recessed inside the second concave surface 35 to suppress deformation of the surface 22 of the panel when the opening 25 is opened, improving a closing performance of the opening 25 by the closing plate 50.

The resealable easy-open end of the present invention includes the tab 40. The tab 40 is riveted to the first button 26 to break the score S to open the opening 25 using the lever principle about the first button 26.

Similar to the well-known structure, the tab 40 has a pressing part 41 formed at a front end thereof and disposed on the opening 25 to break the score S when the opening is opened, a finger portion 42 formed at a rear end thereof and pulled up by a user's finger, and a button coupling part 44 formed at a center thereof and to which buttons are coupled.

The button coupling part 44 is cut around its periphery, except for a surface directed toward a pressing part of the front end. According to the above-mentioned structure, the button coupling part 44 may be called an island structure.

The finger portion 42 includes a tab hole 43 formed in the front thereof to pass therethrough. Edges of the tab hole 43 are bent downward upon formation of the tab hole 43 to increase a cross-sectional strength of the finger portion 42 of the rear end.

In the structure of the well-known tab 40, two button holes are formed in the button coupling part 44. A first button hole 46 disposed at a front side is coupled to the first button 26 protruding from the surface 22 of the panel, a second button hole 47 formed at a rear side of the first button hole 46 is riveted to a second button 52 protruding from the surface of the closing plate 50. The first button 26 and the second button 52 having a protrusion shape pass through the first and second button holes 46 and 47, and upper ends thereof extend outward through pressing to be riveted thereto.

As a result, the tab 40 is rotatably fixed to the surface 22 of the panel by the first button 26, and fixed to the closing plate 50 by the second button 52 to be integrally operated therewith. The first button 26 passes through a button through-hole 51 of the closing plate 50 to be riveted to the tab 40.

According to the present invention, the tab 40 is bent in a triangular shape, a center of which is raised. Accordingly, the tab 40 has two inclined surfaces of the triangle, except for the button coupling part 44 of the island structure. As the tab 40 has the bent shape, when the tab 40 is disposed at the second position, a pressure of the finger portion 42 pressing the closing plate 50 can be increased.

According to the present invention, the tab 40 is rotated between the first position at which the front end pressing part 41 is disposed on the opening 25 of the panel surface 22 and a second position rotated 180 degrees from the first position so that the finger portion 42 is disposed on the opening 25. The first button 26 becomes a rotational center. When the tab 40 is rotated, since the closing plate 50 is integrally coupled to the tab 40 via the second button 52, the closing plate 50 is also rotated with the tab 40. Accordingly, the tab 40 functions as a rotary handle of the closing plate 50.

The resealable easy-open end 10 according to the present invention includes the closing plate 50 disposed between the tab 40 and the panel 20.

The closing plate 50 is a member for closing the opening 25 opened by breaking the score S. The closing plate 50 is formed of a circular plate, and rotated with the tab 40 between the first position and the second position to cover and close the opening at the second position.

The button through-hole 51 through which the first button 26 protruding from the surface 22 of the panel passes is formed in the closing plate 50, and the second button 52 protrudes from a rear side thereof. The second button 52 passes through the second button hole 47 of the tab 40 to be riveted to the tab 40.

A bubble receiving groove 54 protruding upward from a rear side of the second button 52 is provided to receive the leverage bubble 27 formed at the surface 22 of the panel when the closing plate 50 is disposed at the first position.

The bubble receiving groove 54 prevents interference of the closing plate 50 with the leverage bubble 27 formed at the surface 22 of the panel when the closing plate 50 is disposed at the first position, and functions to fix the closing plate 50 at the first position.

According to the present invention, the closing plate 50 includes a finger portion support protrusion 56 formed at a position in contact with the finger portion 42 of the tab 40 to support the finger portion 42 to be raised.

The finger portion support protrusion 56 protrudes upward toward the finger portion 42 and is configured to space the finger portion 42 from the surface of the closing plate 50 so that a user can easily grip the finger portion 42, and evenly distributes the pressing force over the entire surface of the closing plate 50 while preventing deformation of the surface of the closing plate 50 when the finger portion 42 presses the surface of the closing plate 50 at the second position. In addition, the finger portion support protrusion 56 increases the pressing force.

The closing plate 50 is disposed on the first concave surface 30 at the first position, and rotated 180 degrees to cover the opening 25 formed in the first concave surface 30 at the second position.

The first concave surface 30 forms a seating surface of the closing plate 50 at the first position. In addition, the printing space 29 on which a phrase for an event or promotion is printed is provided at the first concave surface 30 hidden by the closing plate 50 when the closing plate 50 is disposed at the first position.

The printing space 29 exposed by rotating the closing plate 50 to the second position is larger than the printing space formed at the rear surface of the tab, various advertisement phrases as well as a simple serial number can be written to enhance event and promotion effects. Moreover, since the printing space 29 can be easily printed and exposed only when the closing plate 50 is rotated with the tab 40, interest and attention can be attracted.

The closing plate 50, after the opening 25 is opened, passes through the region of the second concave surface 35 to move to the second position. Here, since the second concave surface 35 protrudes more than the first concave surface 30, the closing plate 50 is moved in a slightly raised state. However, the closing plate 50 is received in the first concave surface 30 again at the second position to cover and close the opening 25. Since an inner periphery of the first concave surface 30 surrounds an outer periphery of the closing plate 50 at the second position (except for a button direction), the first concave surface 30 improves sealing performance of the opening 25 by the closing plate 50.

Hereinafter, an operation of the resealable easy-open end 10 according to the present invention will be described with reference to FIGS. 5 to 8.

FIGS. 5 and 6 show the resealable easy-open end 10 according to the present invention in a state in which the closing plate 50 and the tab 40 are disposed at the first position.

The closing plate 50 is received in the first concave surface 30, and the finger portion 42 of the tab 40 is spaced apart from the surface of the closing plate 50 by the finger portion support protrusion 56. Accordingly, even when the finger portion 42 of the tab 40 is adhered to the closing plate 50, the user can easily raise the finger portion 42 of the tab 40 because the tab 40 is bent.

When the user raises the finger portion 42 so that the pressing part 41 applies a force to break the score S, the tab 40 is raised by the lever principle so that the pressing part 41 of the tab 40 presses the score S in a state in which the button coupling part 44 of the tab 40 is fixed by the first button 26. Accordingly, as the score S is broken, the opening 25 is pushed into the can to be opened. The user can drink the beverage through the opening 25. In order to close the opening 25 after the beverage is drunk to some amount, or to check the event or promotion phrase after drinking the entire beverage, the closing plate 50 is rotated to the second position. Here, since the tab 40 and the closing plate 50 are coupled by the second button to be integrally operated and pivotally coupled to the first button 25, the user can easily move the closing plate 50 to the second position using the tab 40 as a moving handle of the closing plate 50.

A moved state of the closing plate 50 to the second position will be described with reference to FIGS. 7 and 8. When the closing plate 50 is moved to the second position, first, the printing space 29 disposed at the first position of the closing plate 50 under the closing plate 50 is exposed. The printing space 29 is a space exposed by an active operation of the user so as to gain the consumer's attention and interest and thereby maximize advertisement and promotion effects.

The closing plate 50 covers the opened opening 25 at the second position. Here, the closing plate 50 is not merely disposed on the opening 25. Since the pressing part 41 of the tab 40 is raised by the leverage bubble 27, the finger portion 42 presses the closing plate 50. Here, since the finger portion 42 presses the finger portion support protrusion 56 rather than the closing plate 50, the force is evenly distributed across the surface of the closing plate 50 to press the entire closing plate 50. As described above, since the closing plate 50 is pressed at the second position to cover the opening 25, the opening 25 can be hermetically sealed. Since the opening 25 is closed to prevent leakage of the beverage, the user can easily carry and move the can.

The foregoing description concerns an exemplary embodiment of the invention, is intended to be illustrative, and should not be construed as limiting the invention. The present teachings can be readily applied to other types of devices and apparatuses. Many alternatives, modifications, and variations within the scope and spirit of the present invention will be apparent to those skilled in the art.

The invention claimed is:

1. A resealable easy-open end comprising:

a panel (20) functioning as an end for hermetically sealing a can and having an opening (25) formed at one side thereof and on which a score (S) is engraved;

a tab (40) having a first button hole (46) formed in a button coupling part (44) formed at a center thereof, rotatably coupled to a first button (26) protruding from the panel (20) through the first button hole (46), and rotatably installed between a first position at which a front end pressing part (41) is disposed on the opening (25) and a second position at which a rear end finger portion (42) is disposed on the opening (25); and a closing plate (50) rotatably installed between the first position and the second position, and configured to be supported by the tab (40) at the second position to close the opening (25) when the tab (40) breaks the score to open the opening (25);

wherein the closing plate (50) is disposed between the panel (20) and the tab (40), a second button hole (47) is formed in the button coupling part of the tab (40), a button through-hole (51) through which the first button (26) passes and a protruding second button (52) are formed at the closing plate (50), the first button (26) passes through the button through-hole (51) to be rotatably riveted to the tab (40), and the second button (52)

passes through the second button hole (47) to be riveted thereto, so that the closing plate (50) is integrally rotated with the tab (40).

2. The resealable easy-open end according to claim 1, wherein a leverage bubble (27) is formed at a surface (22) of the panel (20) to raise the pressing part (41) of the tab in a state in which the tab (40) is disposed at the second position so that the finger portion (42) presses the closing plate (50) according to the lever principle, and the closing plate (50) has a bubble receiving groove (54) to receive the leverage bubble (27) to prevent interference of the leverage bubble (27) with the closing plate (50) when the closing plate (50) is disposed at the first position.

3. The resealable easy-open end according to claim 2, wherein the closing plate (50) has a finger portion support protrusion (56) protruding upward toward the finger portion (42).

4. The resealable easy-open end according to claim 2, wherein the tab (40) is bent in a triangular shape by raising a center portion thereof.

5. The resealable easy-open end according to any one of claims 2 to 4, wherein a first concave surface (30) having a recessed surface shape and receiving the closing plate (50) at a region corresponding to the first position and the second position of the closing plate (50) is formed on the surface (22) of the panel (20).

6. The resealable easy-open end according to claim 5, wherein a second concave surface (35) having a region of the first concave surface (30) and a region corresponding to a path through which the closing plate (50) moves between the first position and the second position is provided on the surface (22) of the panel (20), and thus, a step is formed at a boundary between the surface (22) of the panel, the first concave surface (30) and the second concave surface (35), and a boundary between the first concave surface (30) and the second concave surface (35).

7. The resealable easy-open end according to claim 1, wherein a printing space (29) on which a phrase for an event or promotion is printed is provided at the surface (22) of the panel (20) under the second position of the closing plate (50), and the printing space (29) is exposed when the closing plate (50) is moved with the tab (40) to the second position.

* * * * *